US005737664A

United States Patent [19]

Fukuda et al.

[11] Patent Number: 5,737,664

[45] Date of Patent: Apr. 7, 1998

[54] OVERHEATING PREVENTION DEVICE FOR A FIXING UNIT

[75] Inventors: Masahiro Fukuda; Shigeki Nakajima; Koji Morimoto; Takashi Wakana; Takao Uchida; Naoki Sunaga, all of Tokyo, Japan

[73] Assignee: Oki Electric Industry Co., Ltd., Tokyo, Japan

[21] Appl. No.: 490,841

[22] Filed: Jun. 15, 1995

[30] Foreign Application Priority Data

Jun. 17, 1994 [JP] Japan ..... 6-159254
Jun. 17, 1994 [JP] Japan ..... 6-159255

[51] Int. Cl.[6] ..... G03G 15/20

[52] U.S. Cl. ..... 399/33; 399/69; 399/330; 219/471; 219/216

[58] Field of Search ..... 355/282, 285, 355/290, 295; 219/216, 244, 469, 471, 510; 399/33, 67, 69, 330

[56] References Cited

U.S. PATENT DOCUMENTS

| | | | |
|---|---|---|---|
| 4,162,847 | 7/1979 | Brandon | 355/285 |
| 4,541,708 | 9/1985 | Shigenobu | 355/285 X |
| 5,019,692 | 5/1991 | Nbedi et al. | 219/469 |
| 5,287,155 | 2/1994 | Aral et al. | 355/285 |
| 5,329,342 | 7/1994 | Shirai et al. | 355/285 |
| 5,528,345 | 6/1996 | Hasegawa | 355/285 X |

FOREIGN PATENT DOCUMENTS

| | | |
|---|---|---|
| 63-109482 | 5/1988 | Japan . |
| 63-159890 | 7/1988 | Japan . |
| 1-179969 | 7/1989 | Japan . |
| 6-289744 | 10/1994 | Japan . |

*Primary Examiner*—Nestor R. Ramirez
*Attorney, Agent, or Firm*—Panitch Schwarze Jacobs & Nadel, P.C.

[57] ABSTRACT

When the surface temperature of a heating roller exceeds a predetermined temperature, bearings that rotatably support the heating roller melt. Thus, a pressuring roller causes the heating roller to move toward a temperature detecting device. Thus, the heating roller comes in contact with the temperature detecting device. Consequently, when a defect takes place, the warm-up time after the temperature detecting device works until the power to the heater is shut off can be reduced. In addition or in the alternative, an electrode plate has edges electrically contacting and connecting the heater in the heating roller and a power supply. As the heating roller moves, electrical contact between the heater and the electrode plate is broken and the power from the power supply to the heater is disconnected. As a result, an electrophotographic printing apparatus can be prevented from getting defective, thereby improving the reliability thereof.

24 Claims, 10 Drawing Sheets

OVERHEATING PREVENTION DEVICE FOR A FIXING UNIT

BACKGROUND OF THE INVENTION

1. Field of the Invention

The present invention relates to an image fixing unit for use with an electrophotographic printing apparatus or the like.

2. Description of Related Art

An electrophotographic printing apparatus comprises a photographic drum, a printing array that is integrally constructed of an LED array (light emitting diode array) and a SELFOC LENS (a trademark of NIPPON SHEET GLASS CO., LTD.), a primary charger unit, a development unit, an image transfer charger unit, and an image fixing unit.

The primary charger unit charges the front surface of the photosensitive drum.

The printing head exposes the front surface of the photosensitive drum that has been charged so as to form a static latent image corresponding to print image data on the front surface of the photosensitive drum.

The development unit adheres toner particles to a portion corresponding to the static latent image formed on the front surface of the photosensitive drum so as to form a toner image on the front surface of the photosensitive drum.

The image transfer charger unit transfers the toner image adhered to the portion corresponding to the static image formed on the front surface of the photosensitive drum by the development unit to a printing paper.

The image fixing unit pressures and heats the toner particles transferred to the printing paper by the image transfer charger unit so as to fix the toner particles on the printing paper and record the print image data on the printing paper.

Next, an image fixing unit according to the related art reference will be described in detail.

The image fixing unit includes a heating roller and a pressuring roller. The heating roller heats the toner image that has been transferred to the printing paper. The pressuring roller pressures the toner image so as to fix the toner image to the printing paper.

A halogen lamp that is a heat source that heats the front surface of the heating roller is disposed therein. The halogen lamp is electrically connected to a power supply through a metal electrode and a heat resisting wire. The heating roller includes a thermistor that is in contact with the front surface of the heating roller. The thermistor detects the surface temperature of the heating roller. The detected temperature information is input to a control unit. The control unit controls the power supplied to the halogen lamp corresponding to the input temperature information so as to maintain the surface temperature of the heating roller at a predetermined temperature.

In addition, the heating roller includes a thermostat. The thermostat is disposed in the vicinity of and not in contact with the heating roller. The thermostat detects an abnormally high temperature so as to protect the heating roller therefrom. When the surface temperature of the heating roller exceeds a predetermined temperature, the thermostat shuts off the power to the halogen lamp.

The pressuring roller is disposed in parallel with the heating roller so that the pressuring roller is movable in the direction that it is in contact with the heating roller. The pressuring roller includes a spring that always tensions the heating roller.

The image fixing unit causes the printing paper on which the toner image has been formed to pass between the heating roller and the pressuring roller and heats and pressures the toner image transferred to the printing image so as to fix the toner image to the printing paper.

However, in the image fixing unit, the thermostat is not in contact with the heating roller. Thus, the thermostat indirectly detects the temperature of the heating roller through an air layer formed between the thermostat and the heating roller. Since the temperature is indirectly detected, it takes a long time after an abnormally high temperature situation takes place until the thermostat actually works. In addition, the working time of the thermostat varies depending on the deviation of the gap between the thermostat and the heating roller, thereby deteriorating the quality and reliability from safety point of view.

A construction of which the thermostat is disposed in contact with the heating roller may be employed. In this construction, since the temperature of the heating roller is directly detected, the warm-up time until the thermostat actually works can be reduced. However, since the thermostat should be protected from heat, the cost will increase and the front surface of the heating roller will get damaged. The damage of the front surface of the heating roller causes excessive toner particles and power powder of the printing paper to adhere to both the contacting portion of the thermostat and the heating roller and the printing paper, resulting in deteriorating the printing quality.

SUMMARY OF THE INVENTION

An object of the present invention is to provide a system of which a thermostat as a protecting circuit quickly works and shuts off the power to a halogen lamp when the surface temperature of a heating roller abnormally rises due to a defect of a thermistor, a malfunction of a circuit such as a control unit, a defect of a drive circuit, or the like so as to prevent an image fixing unit from getting defective.

Another object of the present invention is to provide an image fixing unit that allows the warm-up time of a thermostat to be short, prevents the front surface of a heating roller from being damaged without need to improve the heat resistance of the thermostat itself, prevents the front surface of the heat roller from being damaged, and prevents print quality from deteriorating due to adhesion of extra toner particles and paper powder at a contact portion.

A further object of the present invention is to provide an electrophotographic printing apparatus that shuts off the power to a halogen lamp without need to use a thermostat upon occurrence of an abnormally high temperature situation of a heating roller due to a defect of a thermistor, a malfunction of a circuit such as a control unit, a defect of a drive circuit so as to prevent an image fixing unit from getting defective. In addition, a more further object of the present invention is to provide an electrophotographic printing apparatus having dual guard construction with a thermostat so as to further improve reliability.

To accomplish at least one of the above-described objects, an image fixing unit for use with an electrophotographic printing apparatus according to the present invention comprises a heater disposed in the heating roller, a power supply means for supplying power to the heater, a tensioning means for tensioning the pressuring roller to the heating roller, a holding means for holding the heating roller against the tension of the tensioning means and for releasing the heating roller when the surface temperature of the heating roller exceeds a predetermined temperature, and a shut-off means for shutting off the power to the heater as the heating roller moves when the holding means releases the heating roller.

These and other objects, features and advantages of the present invention will become more apparent in light of the following detailed description of best mode embodiments thereof, as illustrated in the accompanying drawings.

DESCRIPTION OF THE PREFERRED EMBODIMENTS

Figure 5:
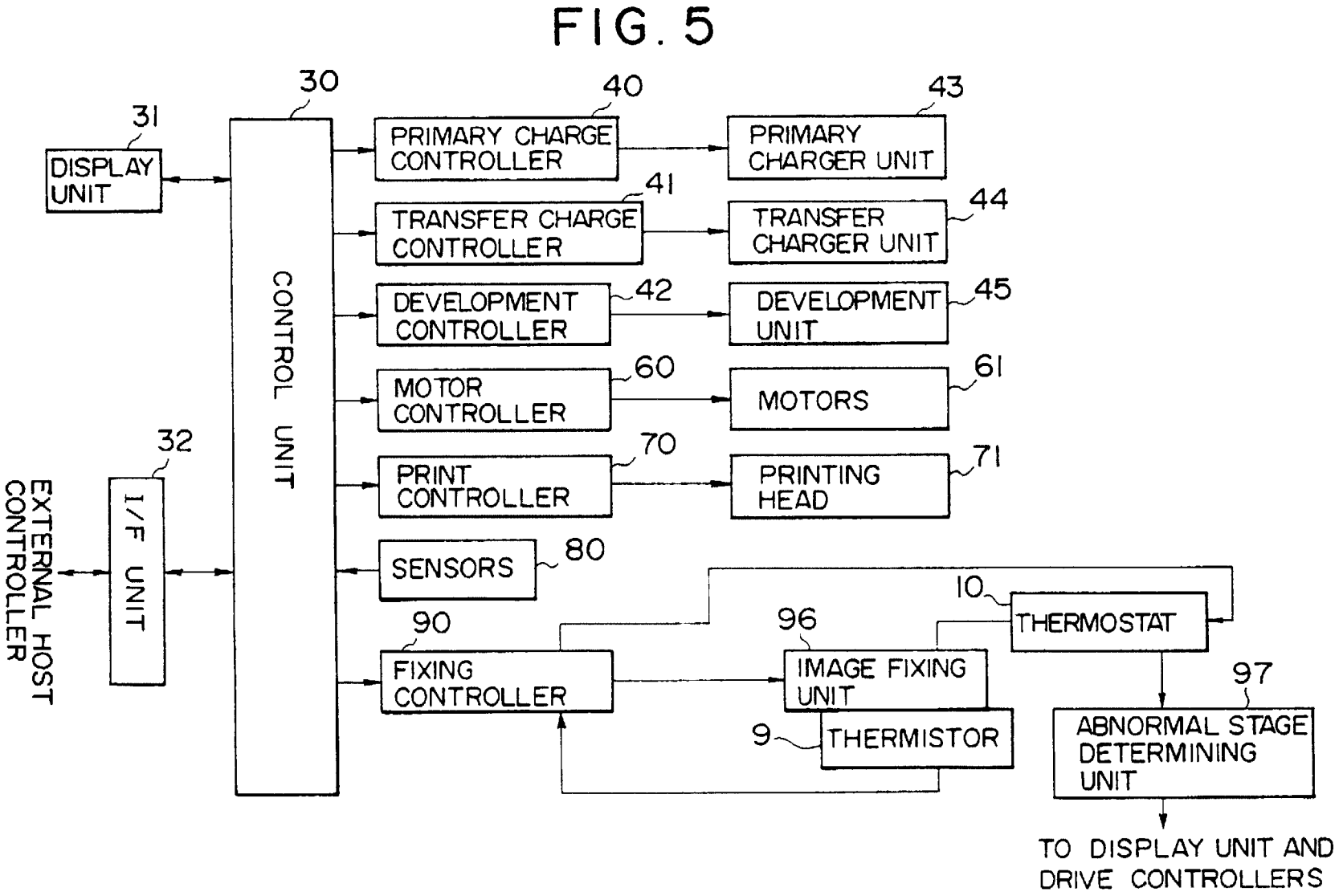
FIG. 5 is a control block diagram of the first embodiment of the present invention.

FIG. 5 is a control block diagram showing the construction of an electrophotographic printing apparatus according to the present invention.

In FIG. 5, a control unit 30 is constructed of a microcomputer or the like that controls the entire operation of the electrophotographic printing apparatus. The control unit 30 is connected to various detecting sensors 80. The control unit 30 detects the position of a printing paper and so forth and controls a primary charger unit 43, a printing head 71, a development unit 45, an image transfer charger unit 44, an image fixing unit 96, a motor 61, and so forth corresponding to detected signals of the detecting sensors 80. An I/F unit 32 is connected to the control unit 30. The I/F unit 32 receives an input signal from an external host controller. In addition, a display unit 31 that displays the status and so forth of the electrophotographic printing apparatus is connected to the control unit 30. The control unit 30 generates image data corresponding to print data and a control command received from the external apparatus through the I/F unit 32. The processed image data is sent to a print controller 70.

The print controller 70 sends the image data received from the control unit 30 to a print head 71. The print head 71 includes a light emission device array. The print head 71 controls the light emission of the light emitting device array corresponding to the input image data. The light emission of the light emitting device array of the print head 71 causes image data of letters and graphics to be formed as a static latent image on the front surface of a photosensitive drum charged by the primary charger unit 43.

The photosensitive drum is rotated by a motor (not shown) under the control of a motor controller 60 so as to successively form a static latent image thereon. The motor controller 60 controls various motors in the electrophotographic printing apparatus so as to drive various conveying rollers that convey the printing paper, a photosensitive drum, a developing roller, a transferring roller, a fixing roller, and so forth.

The development unit 45 adheres toner panicles to a portion corresponding to the static latent image formed on the front surface of the photosensitive drum under the control of the development controller 42.

The transfer charger unit 44 applies a voltage to the toner particles under the control of the transfer charge controller 41 so as to transfer the toner particles corresponding to the static latent image formed on the front surface of the photosensitive drum to the printing paper. The printing paper is conveyed by the conveying roller driven by a motor (not shown) under the control of the motor controller 60. The printing paper is conveyed between the photosensitive drum and the image transfer charger unit 44 in synchronization with a detecting sensor (not shown) so as to transfer the toner particles to the printing paper. Thereafter, the printing paper is conveyed to the image fixing unit 96.

The image fixing unit 96 heats and pressures the toner particles that have been transferred on the printing paper by the image transfer charger unit 44 so as to fix the toner particles to the printing paper. Thereafter, the printing paper is conveyed to the outside of the electrophotographic printing apparatus.

The rest of the toner particles on the front surface of the photosensitive drum is cleaned by a cleaning unit. After the photosensitive drum is cleaned, the front surface of the photosensitive drum is equally charged by the primary charger unit 43 under the control of a primary charge controller 40. The control unit 30 repeatedly performs the above-described operation sequence until there is no print data that control unit 30 receive from the input/output I/F unit. The control unit 30 controls the above-described operation sequence.

Figure 6:
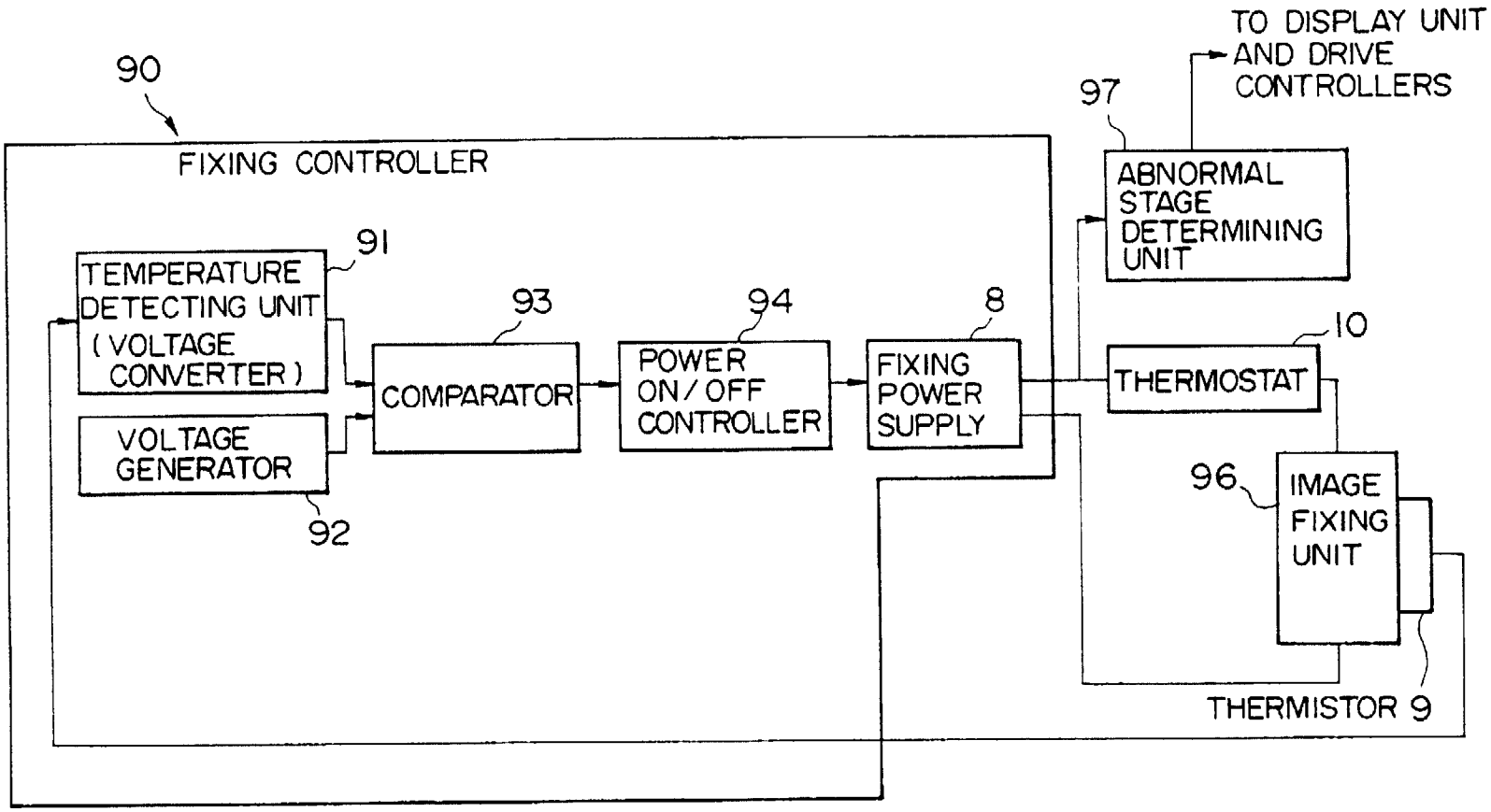
FIG. 6 is a block diagram showing a fixing controller of the first embodiment of the present invention.

Next, with reference to FIGS. 5 and 6, the control of the image fixing unit will be described.

The fixing controller 90 comprises a temperature detecting unit 91, a voltage generator 92, a comparator 93, a power ON/OFF controller 94, and a fixing power supply 8.

The temperature detecting unit 91 receives a signal from a thermistor 9 that detects the temperature of the image fixing unit 96, converts the signal into a voltage value, and outputs the voltage value to the comparator.

The voltage generator 92 generates a predetermined voltage value so as to maintain the temperature of the image fixing unit 96 at a predetermined temperature.

The comparator 93 compares the predetermined voltage value that is output from the voltage generator 92 with the voltage value that is output from the temperature detecting portion and outputs the compared result to the power ON/OFF controller 94.

The power ON/OFF controller 94 inputs the compared result from the comparator 93 and controls the ON/OFF of the power that is supplied to the image fixing unit 96. By repeating the above-described operation sequence, temperature of the image fixing unit 96 is maintained at a predetermined temperature.

Next, the construction of the image fixing unit according to the present invention will be described.

Figure 2:
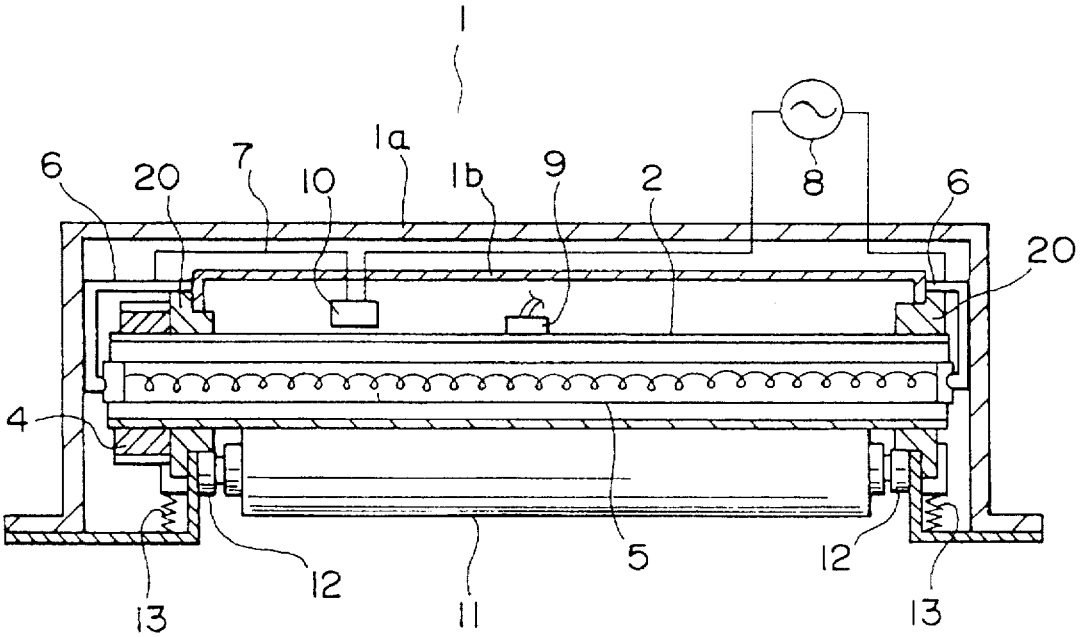
FIG. 2 is a vertical sectional view showing an outlined construction of the image fixing unit according to the first embodiment of the present invention.
Figure 3:
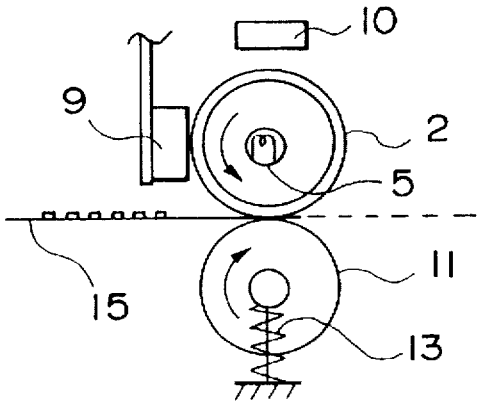
FIG. 3 is a schematic diagram showing a construction of principal portions of the image fixing unit according to the first embodiment of the present invention.

FIGS. 2 and 3 show the image fixing unit according to the present invention. FIG. 2 is a vertical sectional view showing an outlined construction of the image fixing unit according to the present invention. FIG. 3 is a schematic diagram showing the construction of principal portions of the image fixing unit according to the present invention.

In FIGS. 2 and 3, reference numeral 1 is a main body of the image development unit. The main body 1 is constructed of an upper frame 1*a* and a lower frame 1*b*. Reference numeral 2 is a cylindrical open-ended heating roller. The heating roller 2 is rotatably mounted on the lower frame 1*b* through left and right bearings 20. A gear 4 is mounted on one edge of the heating roller 2. The gear 4 transfers the motion of a motor (not shown) to the heating roller 2 so as to rotate the heating roller 2.

The bearings 20 are composed of a material that melts with heat at a particular temperature that is lower than an abnormally high temperature of the front surface of the heating roller 2. The particular temperature is for example in the range from 200 degrees to 230 degrees. The material is for example plastics.

Reference numeral 5 is a halogen lamp that is an electric heat source that heats the heating roller 2. The halogen lamp 5 horizontally extends in the heating roller 2. The halogen lamp 5 is supported by a pair of left and right metal electrodes 6. In addition, the halogen lamp 5 is electrically connected to the fixing power supply 8 through the metal electrodes 6 and the heat resisting wire 7. The metal electrodes 6 have resilient characteristics so that they bend corresponding to the movement of the heating roller 2.

Reference numeral 10 is a thermostat that is a protecting circuit that shuts off the power to the halogen lamp 5 when an abnormally high temperature of the front surface of the heating roller 2 is detected. The thermostat 10 is disposed above and not in contact with the heating roller 10.

Reference numeral 11 is a pressuring roller disposed in parallel with the heating roller 2 in contact state. Both edges of the pressuring roller 11 are mounted on the lower frame 1*b* through the bearings 12. The bearings 12 are movably mounted on the lower frame 1*b* in the direction of which the pressing roller 11 comes in contact with the heating roller 2. Springs 13 that are tensioning means are disposed between the bearings 12 and the lower frame 1*b*. The springs 13 tension the bearings 12 so that the bearing 12 upwardly face. Thus, the pressuring roller 11 always pressures the heating roller 2. The pressuring roller 11 pressures the heating roller 2 in the direction of which the heating roller 2 moves to the thermostat 10 when the bearings 20 melt.

In the image fixing unit, the heating roller 2 and the pressuring roller 11 heat and pressure the printing paper on which a toner image has been formed by the image transfer charger unit 44 so as to fix the toner image to the printing paper. The heating roller 2 that heats the printing paper is internally heated by the halogen lamp 5. A temperature control means such as the thermistor 9 and the fixing controller 90 maintains the surface temperature of the heating roller 2 at a predetermined temperature.

Figure 1A:
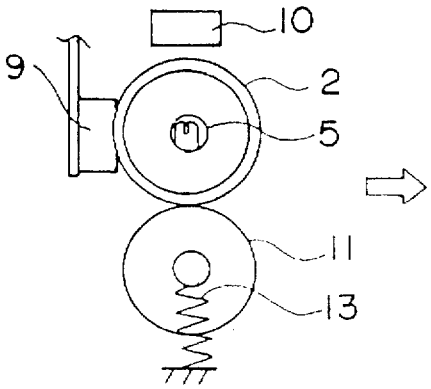
FIGS. 1(*a*) and 1(*b*) are sectional views for explaining the operation of an image fixing unit according to a first embodiment of the present invention.
Figure 1B:
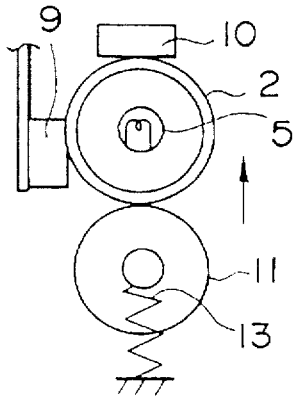

When the surface temperature of the heating roller 2 abnormally rises due to a defect of the thermistor 9, a malfunction of a circuit such as the control unit, a defect of the drive circuit, or the like, the thermostat detects the abnormally high temperature and shuts off the power to the halogen lamp 5. With reference to FIG. 1, the operation of the thermostat 10 will be described in detail.

FIG. 1(*a*) shows the case that the surface temperature of the heating roller 2 is normal. FIG. 1(*b*) shows the case that the surface temperature of the heating roller 2 is abnormally high.

As shown in FIG. 1(*a*), when the surface temperature of the heating roller 2 is normal, the heating roller 2 is rotatably supported by the bearings 20 in such a manner that the heating roller 2 is spaced apart from the thermostat 10.

When the surface temperature of the heating roller abnormally rises, the heat on the front surface of the heat roller 2 causes the bearings 20 to melt. When the bearings start melting, the heating roller 2 that is tensioned by the springs 13 through the pressuring roller 11 start moving to the thermostat 10. When the surface temperature of the heating roller 2 rises to a temperature of which the thermostat 10 works, since the heating roller 2 comes in contact with the thermostat or almost in contact therewith, the thermostat 10 directly detects the surface temperature of the heating roller 2. FIG. 1(*b*) shows the case that the heating roller 2 is in contact with the thermostat 10. When the thermostat 10 detects a temperature exceeding a predetermined temperature, it works and shuts off the power to the halogen lamp 5 so as to prevent the electrophotographic printing apparatus from getting defective.

Figure 4:
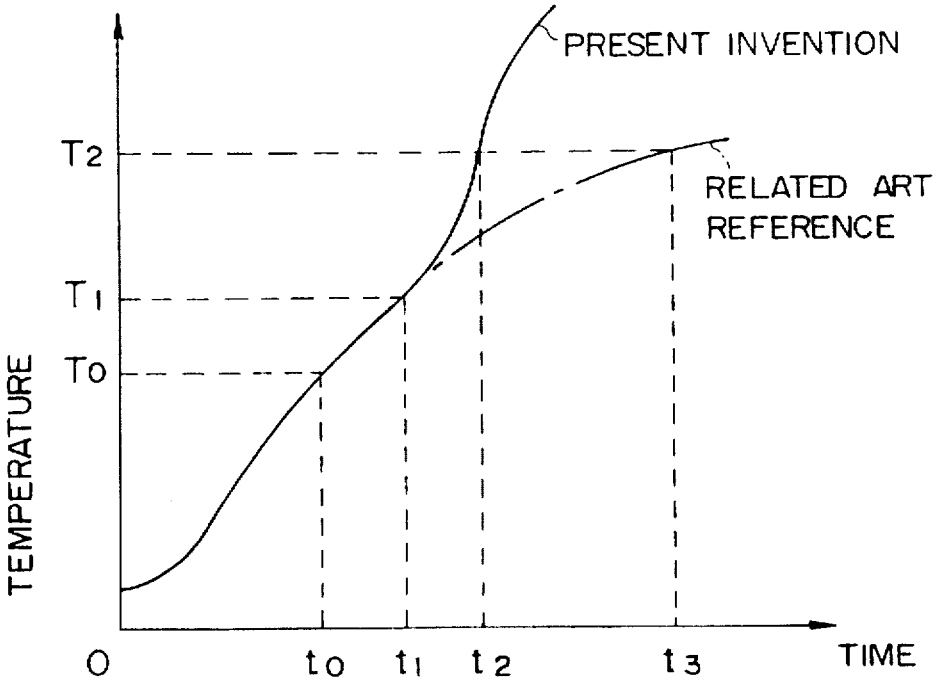
FIG. 4 is a graph showing the operation of a thermostat according to the first embodiment of the present invention.

FIG. 4 is a graph showing the relation between temperatures and working time of the thermostat 10 in the cases of the present invention and the related art reference. In FIG. 4, a solid line represents the case of the present invention and a dashed line represents the case of the related art reference. As shown in FIG. 4, the detecting temperature of the thermostat 10 is T2. When the detecting temperature of the thermostat 10 exceeds T2, the thermostat 10 works and shuts off the power to the halogen lamp 5. The temperature in the normal state is denoted by T0.

The bearings 20, which support the heating rollers 2, melt when the detecting temperature of the thermostat 10 is T1. According to the present invention, since the heating roller 2 approaches the thermostat 10 and then comes in contact therewith at temperature T1 and time t1, the detecting temperature sharply rises unlike with the case of the related art reference denoted by the dashed line. At time t2, the detecting temperature of the thermostat 10 becomes T2. According to the related art reference, at time t3, the detecting temperature of the thermostat 10 becomes T2. Thus, according to the construction of the present invention, when the surface temperature of the heating roller 2 abnormally rises, the warm-up time of the thermostat 10 is reduced for (t3-t2).

In the above embodiment, the construction of which the bearings melt upon occurrence of an abnormally high temperature state and thereby the heating roller 2 comes in contact with the thermostat 10 was described. However, it should be noted that the heating roller 2 may stop the movement just before it is in contact with the thermostat 10.

As a necessary condition of the construction of the present invention, the relation of the positions of the thermostat 10 and the heating roller 2 is not specifically limited as long as when the bearings 20 melt, the heating roller 2 moves to the thermostat 10.

According to the image fixing unit of the present invention, when the surface temperature of the heating roller 2 exceeds a predetermined temperature, the bearings 20 that rotatably support the heating roller 2 melt. The heating roller 2 moves to the thermostat 10 due to the force of the pressuring roller 11. Thus, the pressing roller 11 comes in contact with the thermostat 10. When the surface temperature of the heating roller 2 abnormally rises, the warm-up time after the thermostat 10 works until it shuts off the power to the halogen lamp 5 can be reduced, thereby minimally suppressing the defect of the image fixing unit and so forth and improving the reliability thereof.

Next, the control after the thermostat 10 works will be described.

When the thermostat 10 works and shuts off the power to the halogen lamp 5, an abnormal state determining unit 97 outputs a signal that represents occurrence of an abnormal state to the display unit 31, the I/F unit 32, and each drive control unit. Each drive control unit forcedly stops each drive operation corresponding to the signal received from the abnormal state determining unit 97. The display-unit 31 inputs a signal from the abnormal state determining unit 97 and lights an LED that represents that the image fixing unit is in an abnormal state. On the other hand, the I/F control unit 32 inputs a signal from the abnormal state determining unit 97 and informs the external host controller that the electrophotographic printing apparatus is in an abnormal state.

As described above, according to the image fixing unit of the present invention, when the surface temperature of the heating roller 2 exceeds a predetermined temperature, the thermostat shuts off the power to the halogen lamp 5 in the heating roller 2. In addition, the abnormal state determining unit 97 forcedly stops the operation of each drive control unit, thereby preventing a secondary defect from taking place. In addition, the display unit 31 can inform the user of an abnormal state of the electrophotographic printing apparatus. Moreover, since a signal is sent to the external host controller so as to cause the external host controller to stop sending data to the photographic printing apparatus, the loss of data can be minimized. The abnormal state determining unit 97 stops the operation of each drive control unit without intervention of the control unit, causes the display unit 31 to display an abnormal state, and informs the external host controller of the abnormal state. Thus, even if the control unit or the like malfunctions, the abnormal state determining unit 97 securely stops the operation of the drive system, thereby improving the reliability of the electrophotographic printing apparatus.

Next, a second embodiment of the present invention will be described.

Figure 7:
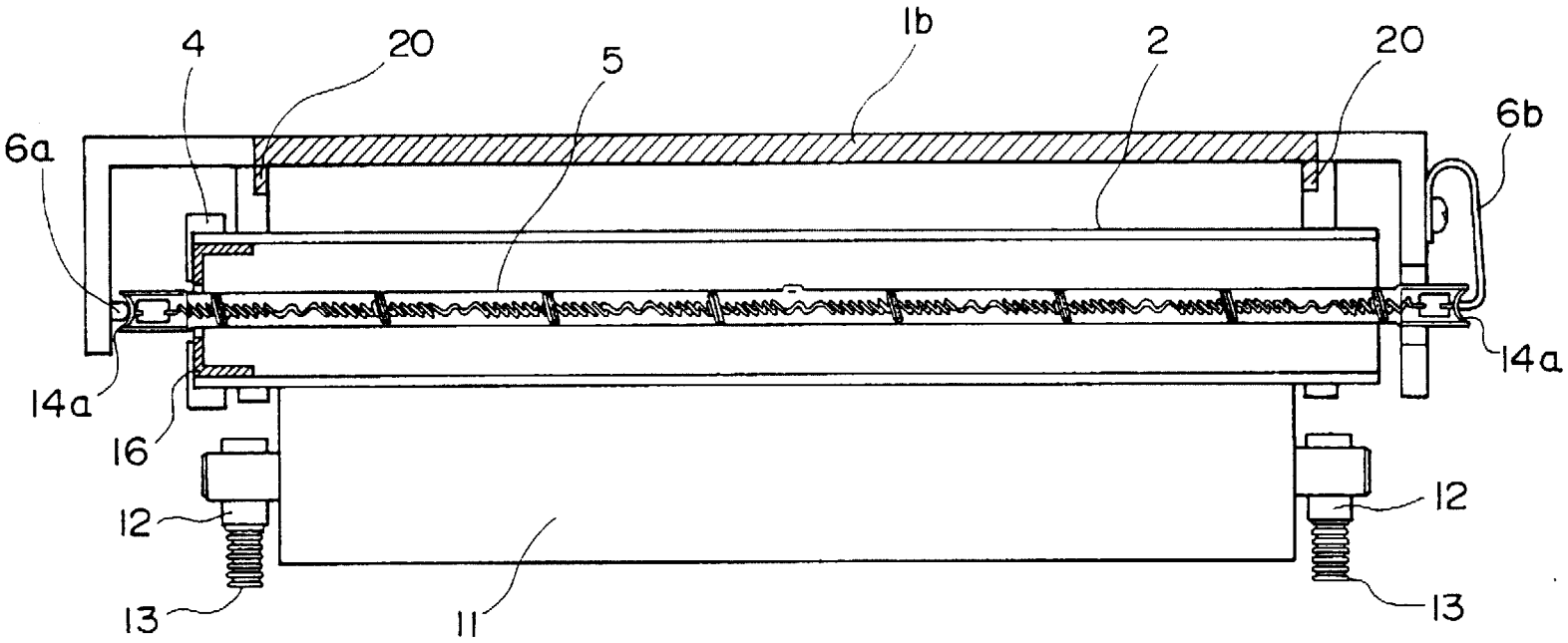
FIG. 7 is a vertical sectional view showing an outlined construction of an image fixing unit according to a second embodiment of the present invention.
Figure 8:
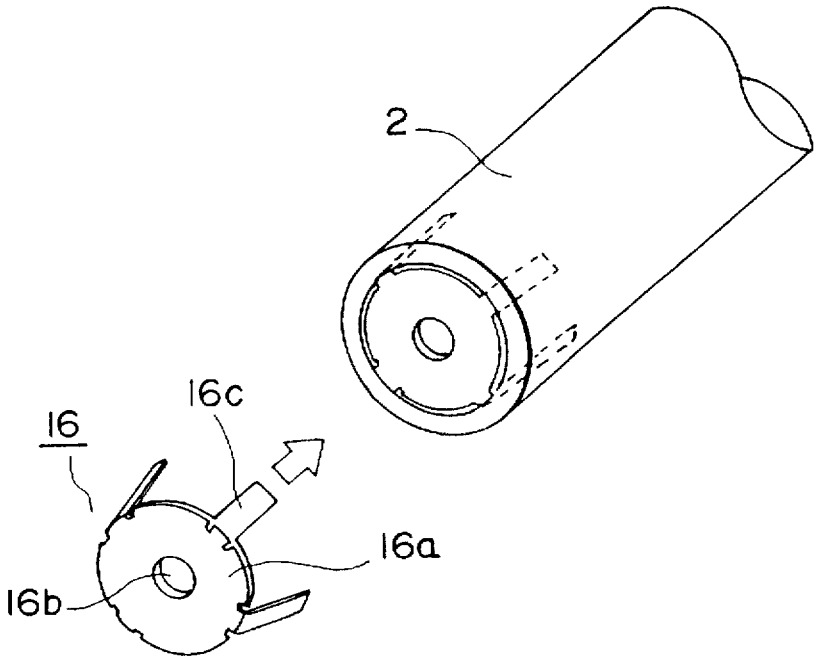
FIG. 8 is a perspective view showing an edge portion of a heating roller according to the second embodiment of the present invention.

FIG. 7 is a vertical sectional view showing an outlined construction of an image fixing unit according to the second embodiment of the present invention. FIG. 8 is a perspective view showing an edge portion of a heating roller 2 according to the second embodiment of the present invention.

In FIG. 7, for simplicity, the description of similar portions to those according to the first embodiment is omitted.

In the second embodiment, a thermostat is not used. When the surface temperature of the heating roller 2 abnormally rises due to a defect of the thermistor 9, a malfunction of a circuit such as the control unit, a defect of the drive circuit, or the like, the power to the halogen lamp 5 is forcedly shut off so as to minimally suppress a defect of the image fixing unit, thereby preventing another portion of the electrophotographic printing apparatus from getting defective.

In FIG. 7, reference numeral 16 is a tension plate disposed at an edge portion in the heating roller 2. Reference numerals **6*a* and 6*b* are electrode plates that supply the power from a power supply to the halogen lamp 5. The electrode plates 6*a* and 6*b* are disposed at both edge portions of the halogen lamp 5**.

Figure 9:
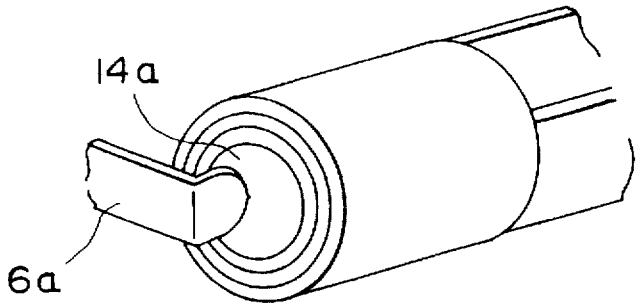
FIG. 9 is a perspective view showing an edge portion of a halogen lamp according to the second embodiment of the present invention.

FIG. 8 is a perspective view showing the tension plate 16. FIG. 9 is a perspective view showing the electrode plate **6*a*. Next, the tension plate 16 and the electrode plate 6*a*** will be described in detail.

In FIG. 8, the tension plate 16 has a disc shaped portion **16*a* and a plurality of legs 16*c*. The disc shaped portion 16*a* has a hole 16*b* through which the halogen lamp 5 passes. The disc shaped portion 16*a* is integrally formed with the legs 16*c*. The diameter of the tension plate 16 is smaller than the inner diameter of the heating roller 2. The legs 16*c* of the tension plate 16 outwardly widen. The tension plate 16 is secured to an inner portion in the vicinity of one edge portion of the heating roller 2 due to bending force of the legs 16*c***.

In FIGS. 7 and 9, the electrode plates **6*a* and 6*b* are disposed at both edge portions of the halogen lamp 5 so as to supply the power to the halogen lamp 5. The electrode plate 6*b* is composed of a leaf spring and disposed in contact with one edge of the halogen lamp 5. The electrode plate 6*b* tensions the other edge of the halogen lamp 5 to the electrode plate 6*a* with constant force. The edge portion of the electrode plate 6*a* is bent so that it is in contact with the halogen lamp 5. The bent portion of the electrode plate 6*a* gradually sharps in the direction of the halogen lamp 5. The electrode plate 6*a* is secured to the frame of the device main body or the like in such a manner that the electrode plate 6*a* is maintained at the same position even if the heating roller 2** is upwardly moved.

Figure 10:
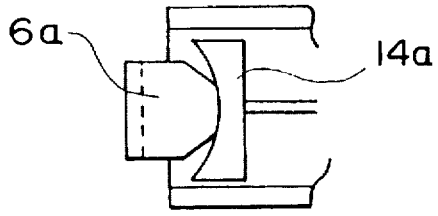
FIG. 10 is a sectional view showing the edge portion of the halogen lamp according to the second embodiment of the present invention.

FIG. 10 is a sectional view showing a contact portion **14*a* at the other edge of the halogen lamp 5 and the electrode plate 6*a***.

In FIG. 10, the contact portion **14*a* of the halogen lamp 5 has a bowl shaped cavity that outwardly widens. The electrode plate 6*a* is in contact with the contact portion 14*a* of the halogen lamp 5. In addition, the electrode plate 6*b* tensions the edge portion of the halogen lamp 5 to the electrode plate 6*a***.

Figure 11A:
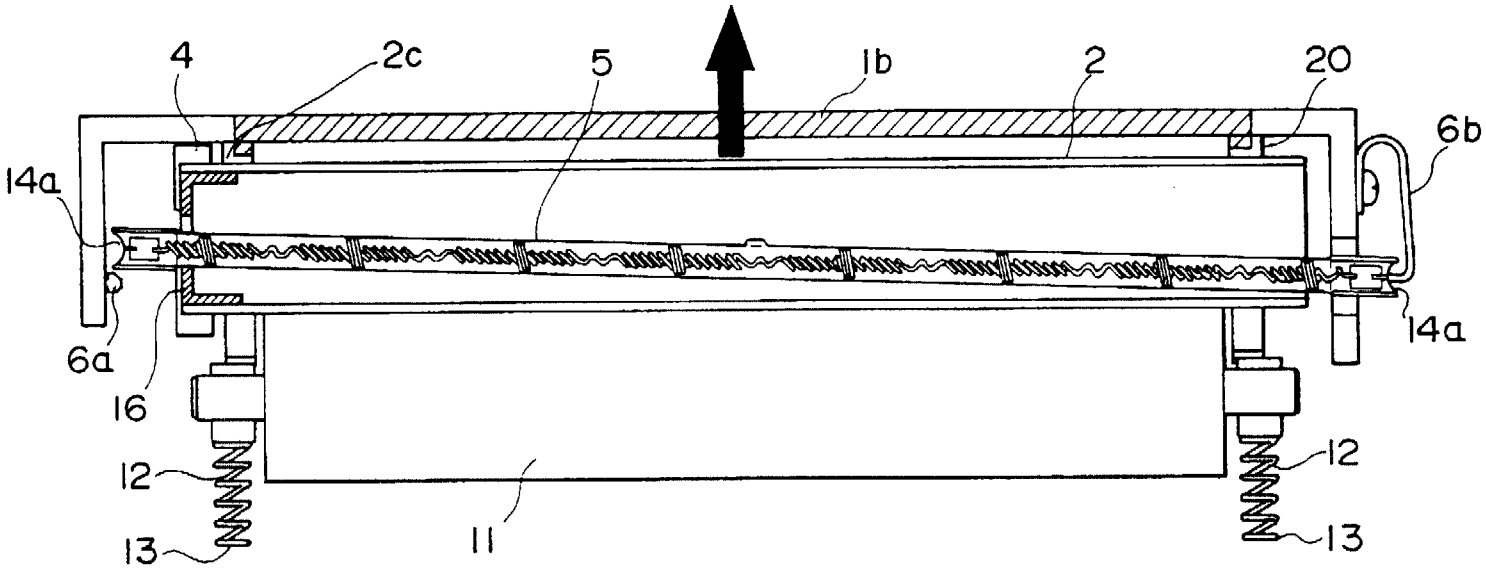
FIGS. 11(*a*) and 11(*b*) are a vertical sectional view and sectional views for explaining the operation of the second embodiment of the present invention.
Figure 11B:
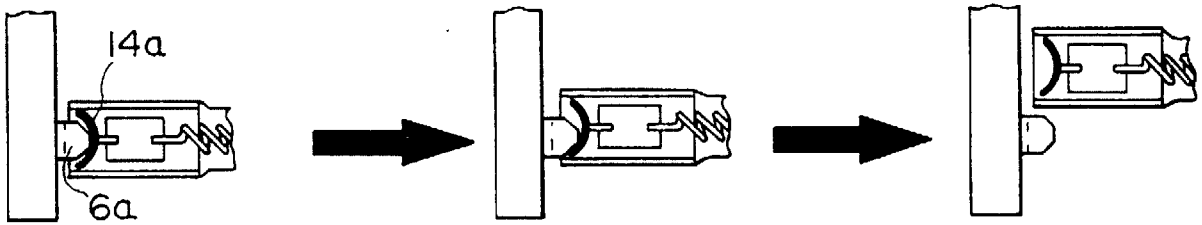

FIGS. 11(*a*) and 11(*b*) are vertical sectional views for explaining the operation of the second embodiment.

As with the first embodiment, when the surface temperature of the heating roller 2 abnormally rises due to a defect of the thermistor 9, a malfunction of a circuit such as the control unit, a defect of the drive circuit, or the like, the bearings 20 melt and the pressuring roller 11 causes the heating roller 2 to move. When the heating roller 2 moves in the arrow direction shown in FIG. 11(*a*), an inner diameter portion of the tension plate 16 disposed in the heating roller 2 comes in contact with the halogen lamp 5. In addition, when the bearings 20 melt, the inner diameter portion of the tension plate 16 causes the halogen lamp 5 to upwardly move. When the halogen lamp 5 upwardly moves, the contact portion **14*a* of the halogen lamp 5 moves in the direction of which the contact portion 14***a* is out of contact with the tension plate 6*a*. FIG. 11(*b*) shows the process of which the contact portion 14*a* of the halogen lamp 5 is out of contact with the tension plate 6*a*. When the contact portion 14*a* of the halogen lamp 5 is out of contact with the tension plate 6*a*, the power to the halogen lamp 5 is forcedly shut off.

As described above, according to the second embodiment of the present invention, when the surface temperature of the heating roller 2 abnormally rises, the power to the halogen lamp 5 can be forcedly shut off without need to use the thermostat. Since the thermostat is not used, the power to the heating roller 2 can be securely shut off irrespective of the deviation of the warm-up time of the thermostat. In addition, it is not necessary to consider the mounting position of the thermostat.

Figure 12:
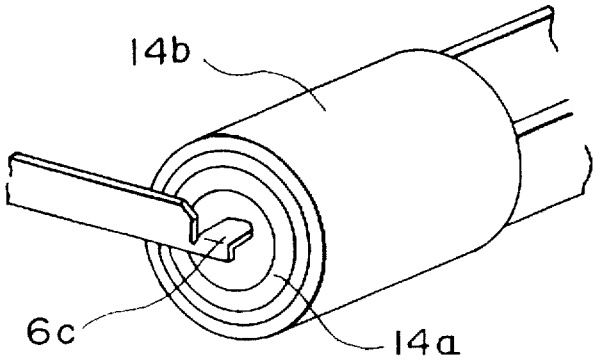
FIG. 12 is a perspective view showing an edge portion of a halogen lamp according to a third embodiment of the present invention.
Figure 13:
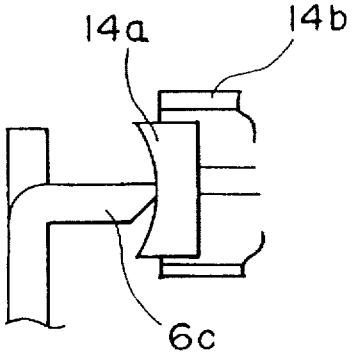
FIG. 13 is a sectional view showing an edge portion of the halogen lamp according to the third embodiment of the present invention.

FIGS. 12 and 13 show the shape of an electrode plate 6*c* and the shape of an edge portion of the halogen lamp 5 according to a third embodiment of the present invention. The shapes of the electrode plate 6*c* and the shape of the edge portion of the halogen lamp 5 according to the third embodiment are different from the shape of the electrode plate 6*a* and the shape of the edge portion of the halogen lamp 5 according to the second embodiment.

A contact portion 14*a* of the halogen lamp 5 is disposed at an outer position of a base portion 14*b* that is composed of ceramics and disposed at an edge portion of the halogen lamp 5. The contact portion 14*a* of the halogen lamp 5 has a bowl shaped cavity portion that outwardly widens.

At an edge portion of the electrode plate 6*c*, a notch portion is formed in a direction perpendicular to the length of the electrode plate 6*c*. A portion that extends from the notch portion to the edge of the electrode plate 6*c* is bent and chamfered toward the contact portion 14*a* of the halogen lamp 5.

When the shape of the electrode plate 6*c* and the shape of the edge portion of the halogen lamp 5 are changed as described above, the electrode plate 6*c* can be securely out of contact with the edge portion of the halogen lamp 5.

Next, a fourth embodiment of the present invention will be described. The fourth embodiment is particularly preferable for the construction of which the thickness of the heating roller 2 is reduced so as to reduce the warm-up time of the image fixing unit 9.

Figure 14:
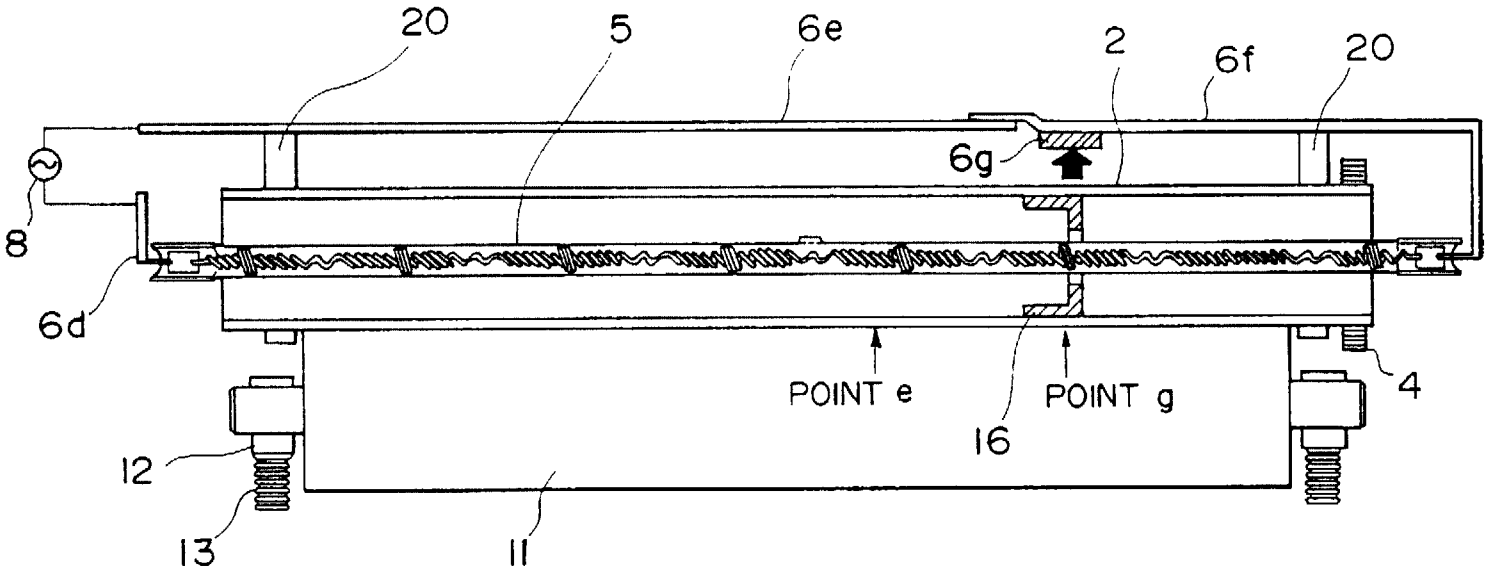
FIG. 14 is a vertical sectional view showing an outlined construction of an image fixing unit according to a fourth embodiment of the present invention.

FIG. 14 is a vertical sectional view showing an image fixing unit according to a fourth embodiment of the present invention. In FIG. 14, for simplicity, the description of similar portions to those according to the first embodiment is omitted.

In FIG. 14, reference numeral 2 is a heating roller. The thickness of the heating roller 2 is reduced so as to decrease the warm-up time of an image fixing unit 96. The heating roller 2 is composed of aluminum with a thickness of 0.2 to 0.8 mm. The heating roller 2 has a paper-peel-off layer composed of fluororesin such as PTFE or PFA. A halogen lamp 5 is disposed in the heating roller 2. The halogen lamp 5 is controlled so that the surface temperature of the heating roller 2 is maintained at a predetermined temperature.

Figure 15:
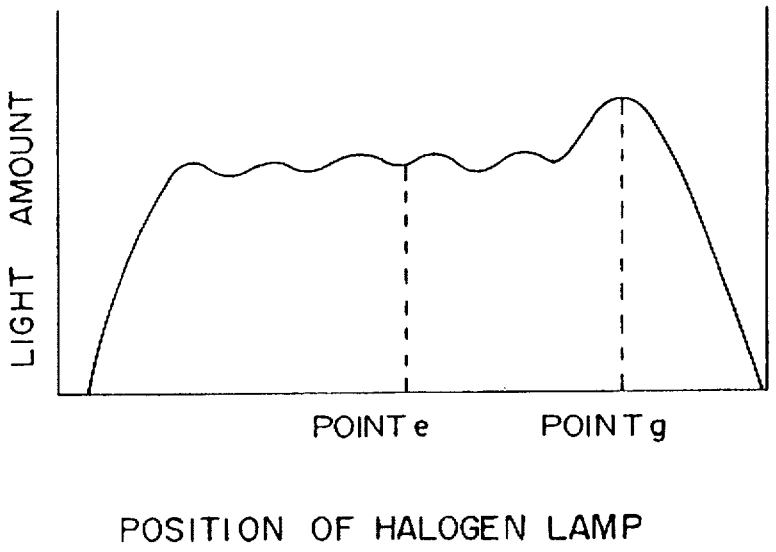
FIG. 15 is a graph showing a light distribution of the fourth embodiment of the present invention.

The heat amount generated from the heating roller 2 is controlled by adjusting the positions of a drive gear, a fan, and so forth so that the temperature distribution becomes equal in the traveling range of the printing paper. FIG. 15 shows the light distribution characteristic of the halogen lamp 5. While the power is continuously supplied to the halogen lamp 5, as shown in FIG. 15, the temperature in the range of a center portion e of the heat roller 2 to a maximum light amount portion g becomes maximum.

Reference numerals 6*d*, 6*e*, and 6*f* are leaf springs composed of phosphor bronze or the like. The power is supplied to the halogen lamp 5 through the leaf springs 6*d*, 6*e*, and 6*f*. The leaf spring 6*d* is tensioned to an edge portion of the halogen lamp 5. The leaf spring 6*f* is tensioned to the other edge portion of the halogen lamp 5. As a necessary condition, the leaf springs 6*d* and 6*e* are electrically connected. Thus, instead of the leaf springs 6*d* and 6*e*, the halogen lamp 5 may be connected to the power supply through a heat resisting wire. Alternatively, the leaf springs 6*d* and 6*e* may be integrally constructed. The leaf springs 6*e* and 6*f* are detachably secured. The leaf spring 6*f* is disposed at the position of which the heating roller 2 maximally bends. A pressuring portion 6*g* is disposed on the leaf spring 6*e* opposite to the heating roller 2 in the vicinity of contact portions of the leaf springs 6*e* and 6*f*.

Reference numeral 16 is a tension plate that has the same construction of that according to the second embodiment. The tension plate 16 is secured at a position of which it maximally bent when the surface temperature of the heating roller 2 abnormally rises. As a necessary condition, the tension plate 16 causes the heating roller 2 to upwardly move. Instead, a protrusion portion that is slightly smaller than the inner diameter of the heating roller 2 may be directly disposed on the halogen lamp 5. The tension plate 16 is disposed between the center position e of the heating roller 2 and the maximum light amount position g as shown in FIG. 14. When the temperature distribution of the heating roller 2 is equal, the center position e of the heating roller 2 is the maximum bending position. When the maximum temperature position deviates due to the light amount distribution of the heating roller 2 in continuous power supply state, the maximum bending position is present between the maximum bending position corresponding to the load position and the maximum temperature position.

Next, the operation of the fourth embodiment of the present invention will be described.

As with the first, second, and third embodiments, when the surface temperature of the heating roller 2 abnormally rises due to a defect of the thermistor 9, a malfunction of a circuit such as the control unit, a defect of the drive circuit, or the like, since the wall thickness of the heating roller 2 is small, the pressuring roller 11 causes the heating roller 2 to bend. The tension plate 16 is disposed in the heating roller 2 at the maximum bending position thereof. The tension plate 16 causes the heating roller 2 to upwardly move. When the heating roller 2 is upwardly moved by the tension plate 16, the heating roller 2 comes in contact with the pressuring portion 6*g* of the leaf spring 6*f* and thereby causes the leaf spring 6*f* to upwardly move. The leaf spring 6*f* is upwardly moved and thereby the leaf spring 6*f* is out of contact with the leaf spring 6*e*. Since the leaf spring 6*e* is out of contact with the leaf spring 6*f*, the power to the halogen lamp 5 is shut off.

According to the fourth embodiment of the present invention, when the surface temperature of the heating roller 2 abnormally rises, the power to the halogen lamp 5 can be forcedly shut off without need to use a thermostat. Since the thermostat is not used, the power to the heating roller 2 can be securely shut off irrespective of the fluctuation of the warm-up time of the thermostat. In addition, it is not necessary to consider the mounting position of the thermostat.

By a combination of the second embodiment and the third embodiment of the present invention, the tension plate 16 causes the halogen lamp 5 to move, thereby causing the edge portion of the halogen lamp 5 to be out of contact with the electrode plate 6*a* or 6*c*. When the bearings of the heating roller 2 are composed of a material with a high heat resistance, the power to the halogen lamp 5 can be shut off without need to cause the bearings to melt.

In addition, by a combination of the first, second, third, and forth embodiments of the present invention, the electrophotographic printing apparatus can be dually or triply prevented from getting defective, thereby further improving the safety of the apparatus.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. An image fixing unit for use with an electrophotographic printing apparatus for causing a printing paper to pass between a heating roller and a pressuring roller for pressuring the heating roller so as to perform a fixing process, the heating roller having an axis, the unit comprising:

a heater disposed in the heating roller;

power supply means for supplying power to said heater;

tensioning means for tensioning the pressuring roller to the heating roller;

holding means for holding the heating roller against the tension of said tensioning means and for releasing the heating roller when the heating roller exceeds a predetermined temperature; and shut-off means for shutting off the power to said heater as the heating roller moves when said holding means releases the heating roller;

wherein the shut-off means is disposed in a path of the power to the heater and is constructed of a temperature detecting device for shutting off the power to the heater when a detected temperature of the heating roller exceeds a predetermined temperature;

wherein the temperature detecting device has a facing surface facing toward the heating roller, the facing surface residing in a plane substantially perpendicular to a plane in which the axis of the heating roller moves, the facing surface having a midline substantially parallel to the axis of the heating roller, the midline substantially coinciding with the plane in which the axis of the heating roller moves; and wherein the temperature detecting device is out of contact with the heating roller for at least an initial period of time as the heating roller moves.

2. The image fixing unit as set forth in claim 1, wherein said holding means is a bearing for rotatably supporting the heating roller and composed of a material that melts when the surface temperature of the heating roller exceeds the predetermined temperature.

3. The image fixing unit as set forth in claim 1, wherein said heater is a halogen lamp.

4. The image fixing unit as set forth in claim 1, further comprising:

drive portions for driving charging means, developing means, image transferring means, and conveying means, the conveying means being adapted for conveying the printing paper; and abnormal state detecting portion for determining an abnormal state when said temperature detecting device has shut off the power to said heater, wherein said abnormal state determining unit is adapted for outputting a shut-off signal for causing the operations of said drive portions of said electrophotographic printing apparatus to be stopped when said temperature detecting device has shut off the power to said heater.

5. The image fixing unit as set forth in claim 4, further comprising:

a display unit for displaying an operation state of said electrophotographic printing apparatus, wherein said display unit is adapted for inputting the shut-off signal from said abnormal state determining unit and for displaying a defect of said image fixing unit corresponding to the shut-off signal.

6. The image fixing unit as set forth in claim 4, further comprising:

an input/output control unit for inputting print data and a control command from an external host controller and for outputting an operation state of said electrophotographic printing apparatus to the external host controller, wherein said input/output control unit is adapted for inputting a shut-off signal from said abnormal state determining unit and for outputting a signal representing an abnormal state of said electrophotographic printing apparatus to the external host controller corresponding to the shut-off signal.

7. An image fixing unit for use with an electrophotographic printing apparatus for causing a printing paper to pass between a heating roller and a pressuring roller for pressuring the heating roller so as to perform a fixing process, comprising:

a heater having a pair of electrodes disposed at both edges of said heater, said heater being disposed in the heating roller;

power supply means for supplying power to said heater;

an electrode plate having a first edge and a second edge, the first edge being connected to each of terminal portions of said power supply means, the second edge being connected to each of the electrodes of said heater;

a bearing for rotatably supporting the heating roller and composed of a material that melts when the surface temperature of the heat roller exceeds a predetermined temperature;

tensioning means for tensioning the pressuring roller to the heating roller; and a tension plate for moving said heater as the heating roller moves due to the tension force of said tensioning means when said bearing melts, wherein at least one of the electrodes of said heater is disconnected from the second edge of said electrode plate as said tension plate moves.

8. The image fixing unit as set forth in claim 7, wherein said tension plate is resiliently held at an edge portion in said heating roller.

9. The image fixing unit as set forth in claim 8, wherein said tension plate has a hole with a diameter of which said heat is not in contact with said tension plate, a disc shaped portion that is smaller than the inner diameter of the heating roller, and a plurality of legs integrally formed with the disc shaped portion and disposed on the outer periphery of the disc shaped portion, and wherein the legs of said tension plate outwardly widen.

10. The image fixing unit as set forth in claim 9, wherein said heater has an inner electric heating wire, an edge of the electric heating wire being constructed of a contact portion with a bowl shaped cavity that outwardly widens from the center portion, wherein the first edge of said electrode plate is formed in a spring shape and fit to the contact portion of the one edge portion of the electric heating wire so as to tension said heater to the inside of the heating roller, and wherein the second edge of said electrode plate is bent to said heater, the bent portion being formed in such a manner that the bent portion gradually thins to said heater so that the tip of the bent portion is detachably connected to the bowl shaped cavity of the electric heating wire.

11. The image fixing unit as set forth in claim 9, wherein said heater is constructed of a glass tube and an electronic heating wire, the glass tube having a base portion composed of ceramics and disposed at an edge portion of said heater, the electric heating wire passing through the glass tube, wherein the edge of the electric heating wire has a bowl shaped cavity that outwardly widens from the center portion, the outer periphery of the bowl shaped cavity protruding outwardly from the base portion, wherein the first edge of said electrode plate is formed in a leaf spring shape and fits to a contact portion of an edge portion of the electric heating wire so as to tension said heater to the inside of the heating roller; and wherein a notch is formed at the second edge of said electrode plate in the direction of which said heater moves, the second edge of said electrode plate being bent from the notch to the tip of said electrode plate, the second edge being chamfered in such a manner that the tip outwardly thins, the tip of said electrode plate being detachably connected to the other edge portion of said electric heating wire.

12. The image fixing unit as set forth in claim 7, further comprising temperature-detecting device for shutting off the power to the heater as the heating roller moves when the bearing melts, wherein the power to the heater is shut off by the temperature-detecting device or by the disconnection of the electrode of the heater from the second edge of the electrode plate.

13. The image fixing unit as set forth in claim 12, wherein said temperature-detecting device is disposed in a path of the power to said heater and constructed of a temperature detecting device for shutting off the power to said heater when the surface temperature of the heating roller exceeds the predetermined temperature, and wherein the temperature detecting device is disposed in the direction of which the heating roller moves when the bearing melts.

14. The image fixing unit as set forth in claim 13, wherein said temperature detecting device is disposed in the direction of which the heating roller moves when the bearing melts, and wherein said temperature detecting device is out of contract with the heating roller as the heat roller moves.

15. The image fixing unit as set forth in claim 14, wherein said heater is a halogen lamp.

16. The image fixing unit as set forth in claim 12, further comprising:

drive portions for driving charging means, developing means, image transferring means, and conveying means, the conveying means being adapted for conveying the printing paper; and abnormal state detecting portion for determining an abnormal state when said temperature detecting device has shut off the power to said heater, wherein said abnormal state determining unit is adapted for outputting a shut-off signal for causing the operations of said drive portions of said electrophotographic printing apparatus to be stopped when said temperature detecting device has shut off the power to said heater.

17. The image fixing unit as set forth in claim 16, further comprising:

a display unit for displaying an operation state of said electrophotographic printing apparatus, wherein said display unit is adapted for inputting the shut-off signal from said abnormal state determining unit and for displaying a defect of said image fixing unit corresponding to the shut-off signal.

18. The image fixing unit as set forth in claim 17, further comprising:

an input/output control unit for inputting print data and a control command from an external host controller and for outputting an operation state of said electrophotographic printing apparatus to the external host controller, wherein said input/output control unit is adapted for inputting a shut-off signal from said abnormal state determining unit and for outputting a signal representing an abnormal state of said electrophotographic printing apparatus to the external host controller corresponding to the shut-off signal.

19. An image fixing unit for use with an electrophotographic printing apparatus for causing a printing paper to pass between a heating roller and a pressuring roller for pressuring the heating roller so as to perform a fixing process, comprising:

a heater having a pair of electrodes disposed at both edges of said heater, said heater being disposed in the heating roller;

power supply means for supplying power to said heater;

an electrode plate having a first edge and a second edge, the first edge being connected to each of terminal portions of said power supply means, the second edge being connected to each of the electrodes of said heater;

a bearing for rotatably supporting the heating roller;

tensioning means for tensioning the pressuring roller to the heating roller; and a tension plate for moving said heater as the heating roller bends when the surface temperature of the heating roller exceeds a predetermined temperature;

wherein said electrode plate has at least one contact portion in the path of power from said power supply means to said heater, the contact portion being out of contact with said tension plate as said tension plate moves so as to shut off the power to said heater.

20. The image fixing unit as set forth in claim 19, wherein said tension plate is disposed in the heating roller at a position of which the heating roller is maximally bent when the surface temperature of the heating roller exceeds the predetermined temperature.

21. The image fixing unit as set forth in claim 20, wherein said electrode plate comprises:

a first electrode plate member having a first edge and a second edge, the first edge being fit to one edge of said heater, the second edge being fit to one edge of said power supply means;

a second electrode plate member having an edge fit to the other edge of said power supply means; and a third electrode plate member having an edge fit to the other edge of said heater, and wherein the other edge of said second electrode plate member and the other edge of the third electrode plate member are detachably connected above a position of which the heating roller maximally bents when the surface temperature of the heating roller exceeds the predetermined temperature.

22. The image fixing unit as set forth in claim 21, wherein the third electrode plate member is disposed above the position of which the heating roller maximally bents and has a protrusion portion formed opposite to the heating roller.

23. The image fixing unit as set forth in claim 19, wherein said tension plate is formed in a disc shape, the size of said tension plate being smaller than the inner diameter of the heating roller, said tension plate being integrally formed with said heater.

24. The image fixing unit as set forth in claim 19, wherein the heating roller has an outer paper-peel-off layer composed of fluororesin with a thickness of 0.2 to 0.8 mm.

* * * * *